United States Patent [19]

Melvin

[11] 4,365,804

[45] Dec. 28, 1982

[54] KEEPER FOR A GAME MISSILE AND A GAME IMPLEMENT

[76] Inventor: Stephen R. Melvin, 13 Highland Ave., Montville, N.J. 07045

[21] Appl. No.: 227,173

[22] Filed: Jan. 22, 1981

[51] Int. Cl.[3] ..... A63B 47/00

[52] U.S. Cl. ..... 273/25; 224/919; 273/29 R

[58] Field of Search ..... 273/25, 26 R, 29 R, 273/29 A, 32 D, 73 R, 76, 162 R, 162 C; 131/241; 224/217, 219, 919; 206/315 R, 315 B; 215/306, 317, 321

[56] References Cited

U.S. PATENT DOCUMENTS

| | | | |
|---|---|---|---|
| 2,222,741 | 11/1940 | Bush | 224/217 |
| 2,796,067 | 6/1957 | McCutcheon et al. | 131/241 X |
| 2,932,514 | 4/1960 | Bergmark | 273/73 R |
| 4,061,256 | 12/1977 | Beer et al. | 224/919 X |
| 4,062,482 | 12/1977 | Szalony | 224/919 X |
| 4,183,526 | 1/1980 | Brown | 273/73 R |
| 4,294,386 | 10/1981 | Ingram | 224/919 X |

*Primary Examiner*—Anton O. Oechsle
*Attorney, Agent, or Firm*—Bernard J. Murphy

[57] ABSTRACT

According to the embodiments depicted, the keeper comprises a plastic article of manufacture having an annulus for receiving therein a game implement, such as a baseball bat, and another annulus for receiving therein a game missile, such as a baseball. The latter annulus has joined thereto a hemispheric cup in which to retain the missile. The annuli are joined together by means of a web, and the missile-receiving annulus is reinforced with an annular rib.

6 Claims, 4 Drawing Figures

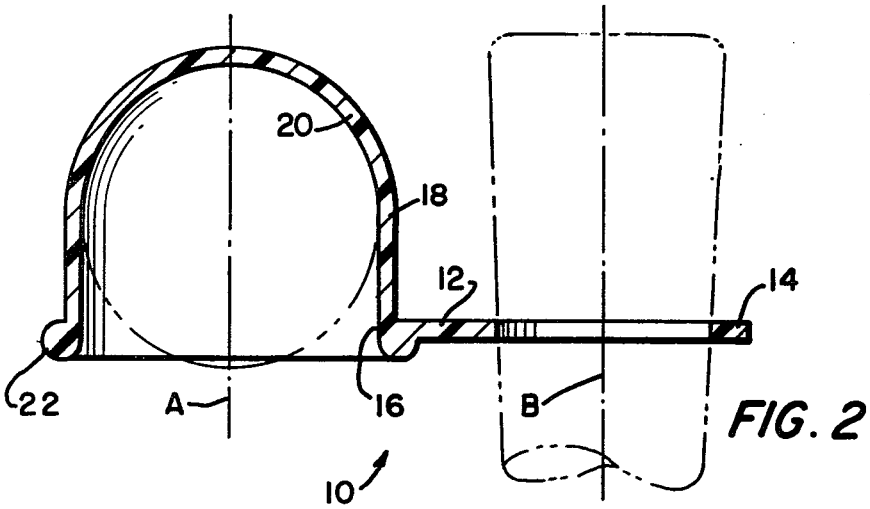
FIG. 2
FIG. 1
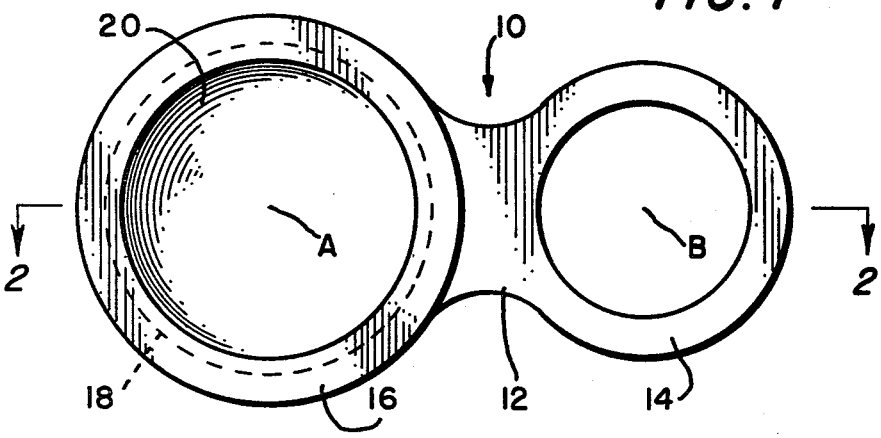
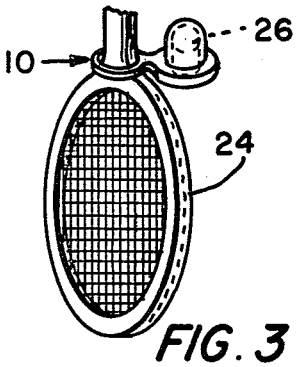
FIG. 3
FIG. 4
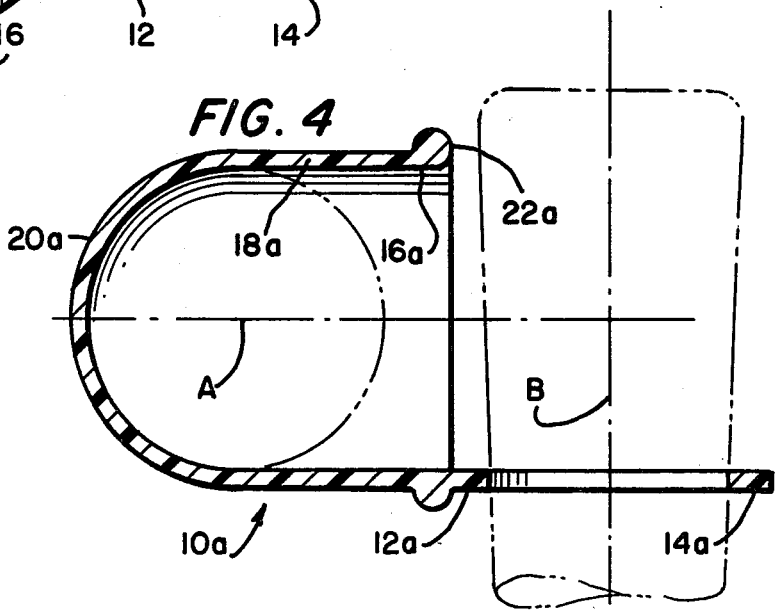

KEEPER FOR A GAME MISSILE AND A GAME IMPLEMENT

This invention pertains to game apparatus, and in particular to such apparatus used for keeping game articles in stored readiness.

Typically, game articles get separated, following game play, and either a considerable amount of time must be expended in ferreting out the missing article or articles, in order that subsequent game play might be pursued, or the missing article or articles have to be replaced. The replacement is expensive and, even if replacement proves unnecessary, as an extended search uncovers what was missing, it is regrettable that time must be expended in searching. It is usually not sufficient for the players to be cautioned to keep the game articles together, so the latter can be readily located when a subsequent game is desirable. Consider the game articles for baseball. While a bat, ball and glove may be deposited in one location, following a game, it will occur that, later, just the ball and glove will be removed for practice catching, and deposited somewhere else after that practicing. When it is desired to gather up the articles for a game of baseball, a glove and/or a ball may be found, but not the bat. Alternatively, the bat and glove may be located, but the ball may be missing.

What has been needed is some means for lashing together the basic elements of game play: the game missile (such as a baseball) and the game implement (such as a bat). Well, there is no reasonable way to lash such articles together. What is required is some type of keeper therefor.

It is an object of my invention to provide just such a keeper, for a game missile and a game implement. Particularly it is an object of my invention to set forth a keeper, for a game missile and a game implement, comprising a web; a first annulus coupled to said web; and a second annulus coupled to said web; wherein one of said first and second annuli has a diameter substantially corresponding to a cross-sectional dimension of a game missile; and the other of said first and second annuli has a diameter substantially corresponding to a cross-sectional dimension of a game implement.

Further objects of this invention, as well as the novel features thereof, will become more apparent by reference to the following description, taken in conjunction with the accompanying figures, in which:

FIG. 1 is a plan view of an embodiment of the novel keeper, according to the invention;

FIG. 2 is a cross-sectional view taken along section 2—2 of FIG. 1;

FIG. 3 is an isometric projection of the keeper of FIGS. 1 and 2, shown in conjunction with a portion of a tennis racquet (and a tennis ball); and FIG. 4 is a cross-sectional view, similar to that of FIG. 2, of an alternative embodiment of the inventive keeper.

As shown in FIGS. 1 and 2, an embodiment 10 of a keeper for a game missile and a game implement is shown as a one-piece, plastic article of manufacture.

Keeper 10 comprises a web 12 and a pair of annuli 14 and 16 disposed at opposite sides of the web. Annulus 16 has a sleeve 18 joined thereto, and the sleeve, in turn, has a hemispheric cup 20 integral therewith. As shown in the Figures, sleeve 18 defines a straight cylinder, and it is tangential to the hemispheric cup 20. Annulus 14, in a first embodiment of the invention, has a diameter of 2.4 inches (approx. 63 mm.), and annulus 16 has a diameter of 2.85 inches (approx. 73 mm.). Accordingly, annulus 14 will not allow a baseball bat to pass fully therethrough. As shown in FIG. 2, in phantom, a baseball bat comes into fast engagement with annulus 14—with the peripheral wall thereof. Thus, if the handle of the bat is passed through annulus 14, the keeper will come to engaged rest some short distance from the other end of the bat. Then, it remains only to push a baseball in through annulus 16 for nesting thereof in the cup 20. For this purpose, annulus 16 has the aforesaid diameter, and again in phantom, in FIG. 2, a baseball is shown nested in cup 20.

Most of the baseball is confined in the cup 20, sleeve 18 and annulus 16, and as the sleeve and annulus have a diameter substantially corresponding with the diameter of a baseball, the latter will not accidently come free. It is held in place, frictionally. Now, the bat can be carried by its handle, and joined in one, secure package, are the bat, keeper 10 and the baseball. The keeper 10 is formed of plastic, in this embodiment, of durable but supple constitution. Annulus 16 has a reinforcing rib 22. Even so, when the bat and baseball are removed from the keeper 10, the latter can be folded up into a small volume and pocketed.

Thus far, I have described the invention in connection with the keeping of a baseball and bat. Well, the invention is broader than that use. Patently, the keeper 10 can be dimensioned to keep a badminton racquet and shuttlecock, in which the cork or rubber or plastic nose of the shuttlecock would be nested in an appropriately dimensioned annulus 16, sleeve 18 and cup 20. Too, a paddle and ball, or a tennis racquet and ball, etc. can be kept by appropriately dimensioned keepers, pursuant to my teaching through keeper 10. Such another practice, for a tennis racquet 24 and ball 26, is depicted in FIG. 3.

Annuli 14 and 16 have parallel axes "A" and "B". In the alternative embodiment of a keeper 10*a*, shown in FIG. 4, the corresponding axes "A" and "B" lie substantially normal to each other. This embodiment may have some advantage over the first embodiment, in that the clasped implement (bat, or the like) traverses the front of the annulus 16*a*. Accordingly, the implement provides a bar to the inadvertent dislodgement of the missile (baseball, or the like) from the cup 20*a*, sleeve 18*a* and annulus 16*a*.

While I have described my invention in connection with specific embodiments thereof, it is to be clearly understood that this is done only by way of example, and not as a limitation to the scope of my invention as set forth in the objects thereof and in the appended claims. Other embodiments of the invention will occur to others, surely. For instance, another embodiment of the novel keeper can take the form of one implement annulus, like annulus 14, for a golf club, and a plurality of annuli, like annulus 18, in radial array thereabout. Thus, a plurality of golf balls could be kept with the golf club. Such as embodiment, with a radial array of missile annuli, and sleeves and cups, could also be of use with a tennis racquet and a plurality of tennis balls. Also, I define the keepers 10 and 10*a* as being made of plastic. Well, obviously, they could be made of rubber, or leather, or the like. These and other alternative embodiments and modifications of my invention will come to the minds of others, from the teaching of my invention. All such proceed from my disclosure, and are deemed to be within the ambit of my invention, and embraced by the appended claims.

I claim:

1. A keeper, for a game missile and a game implement, comprising:

a first annulus;

a second annulus coupled to said first annulus; wherein one of said first and second annuli has an inside diameter substantially corresponding to a cross-sectional dimension of a game missile;

the other of said first and second annuli has an inside diameter substantially corresponding to a cross-sectional dimension of a game implement;

a sleeve integral with said one annulus;

a hemispheric cup integral with said sleeve;

said sleeve defining a straight cylinder, and being tangential to said cup;

said cup, sleeve and other annulus being formed of a common material and having a substantially common material thickness of a given dimension;

said one annulus, sleeve and cup have a common, first axis;

said other annulus has a second axis;

said other annulus has an axial length of said given dimension, corresponding to said material thickness; and said cup, sleeve, and annuli are of one-piece construction.

2. A keeper, according to claim 1, wherein:

said diameters are of diverse dimensions.

3. A keeper, according to claim 1, wherein:

at least one of said annuli has a reinforcing means.

4. A keeper, according to claim 3, wherein:

said reinforcing means comprises an annular rib.

5. A keeper, according to claim 1, wherein:

said axes are substantially parallel.

6. A keeper, according to claim 1, wherein:

said axes are substantially normal to each other.

* * * * *